United States Patent [19]

Takehara et al.

[11] Patent Number: 4,620,096

[45] Date of Patent: Oct. 28, 1986

[54] THERMAL DEVELOPING AND TRANSFERRING METHOD

[75] Inventors: Nobumitsu Takehara; Kazuhiko Yanagihara; Masahiro Ohnishi; Shigeo Harada, all of Kanagawa, Japan

[73] Assignee: Fuji Photo Film Co., Ltd., Kanagawa, Japan

[21] Appl. No.: 814,023

[22] Filed: Dec. 23, 1985

Related U.S. Application Data

[63] Continuation of Ser. No. 593,002, Mar. 23, 1984, which is a continuation of Ser. No. 545,294, Oct. 25, 1983, abandoned.

[30] Foreign Application Priority Data

Oct. 25, 1982 [JP] Japan ..... 57-186921

[51] Int. Cl.[4] ..... G03C 5/16

[52] U.S. Cl. ..... 250/319; 250/318; 250/317.1

[58] Field of Search ..... 250/317.1, 318, 319

[56] References Cited

U.S. PATENT DOCUMENTS

| | | | |
|---|---|---|---|
| 3,946,230 | 3/1976 | Sullivan | 250/319 |
| 4,409,316 | 10/1983 | Ziller-Pendrey et al. | 430/259 |
| 4,430,415 | 2/1984 | Aono et al. | 430/203 |
| 4,463,079 | 7/1984 | Naito et al. | 430/559 |

*Primary Examiner*—Bruce C. Anderson

*Attorney, Agent, or Firm*—Sughrue, Mion, Zinn, Macpeak, and Seas

[57] ABSTRACT

A method and apparatus for developing and transferring an image from a sheet of thermally developing photo-sensitive paper N containing a mobile pigment to a sheet of print paper P containing a pigment fixer, comprising a thermal developer 4 of the photo-sensitive paper, means for overlaying the photo-sensitive and print paper, a heater 8 for transferring the mobile pigments from the developed photo-sensitive paper to the print paper, and a separator 54 for peeling apart the photo-sensitive and print papers.

7 Claims, 5 Drawing Figures

THERMAL DEVELOPING AND TRANSFERRING METHOD

This is a continuation of application Ser. No. 593,002 filed 3-23-84, which is a continuation of application Ser. No. 545,294 filed 10-25-83, now abandoned.

BACKGROUND OF THE INVENTION

This invention relates to a novel thermal developing and transferring method in which a developed image is transferred from a photo-sensitive paper to a print paper. In particular, it relates to the transfer of a colored image.

One example of a thermal developing photo-sensitive paper employable in the invention is a color sensitive paper which, as disclosed by Japanese patent application No. 157798/1981 (Japanese patent application Laid-Open No. 58543/1983), contains a pigment carrier which reduces at least photo-sensitive silver halide, organic silver salt oxidizer, hydrophilic binder and pigment expelling agent. As a result of a chemical reaction, the photo-sensitive paper expels a hydrophilic pigment. When the thermal developing color photo-sensitive paper is subjected merely to thermal developing after exposure of the image, a silver image is formed in the exposed portion of the paper while the mobile hydrophilic pigment is provided in the portion thereof which corresponds with the silver image. The photo-sensitive layer is thus composed of negative photo-sensitive material. In other words, the thermal developing color photo-sensitive paper is subjected to image exposure and then to thermal developing, and an oxidation-reduction reaction takes place between the organic silver salt oxidizer and the reduceable pigment carrier with the exposed photo-sensitive silver halide acting as a catalyst. The silver image is formed in the exposed portion of the photo-sensitive paper. In this step, the pigment carrier is oxidized into an oxide by the organic silver salt oxidizer. The oxide is excised under the presence of the pigment expelling agent, as a result of which the mobile hydrophilic pigment is expelled. Accordingly, the silver image and the mobile hydrophilic pigment are provided in the exposed portion, and a color image can be obtained by transferring the hydrophilic pigment onto the print paper.

In the case where the photo-sensitive layer is made of positive photo-sensitive material, the silver image and the mobile hydrophilic pigment are provided in the portion of the material which is not exposed.

The print paper employable in the invention is made up of a support layer and a print layer formed on the support layer. The print layer can receive a pigment which is expelled from the photo-sensitive paper during thermal developing. The print layer contains a pigment agent such as a pigment mordant. Suitable pigment fixing agents can be used selectively according to the properties of the expelled pigment, the other components contained in the thermal developing photo-sensitive paper and the transferring conditions. For instance, a macromolecular weight polymer mordant may be employed as disclosed in Japanese patent application No. 157798/1981 (Japanese patent application Laid-Open No. 58543/1983).

SUMMARY OF THE INVENTION

An object of this invention is to provide a method for improving a thermal developing and transferring operation by using the above-described thermal developing photo-sensitive paper and print paper.

The foregoing object of the invention has been achieved by the provision of a thermal developing and transferring method which comprises: a thermal developing step of heating an exposed thermal developing photo-sensitive paper in order to expel pigment; an overlaying step of laying a print paper having a pigment fixing layer on the thermal developing photosensitive paper; a transferring step of transferring the pigment expelled from the photo-sensitive paper onto the print paper; and a removing step of peeling off the photo-sensitive paper from the print paper.

DETAILED DESCRIPTION OF THE INVENTION

Figure 1:
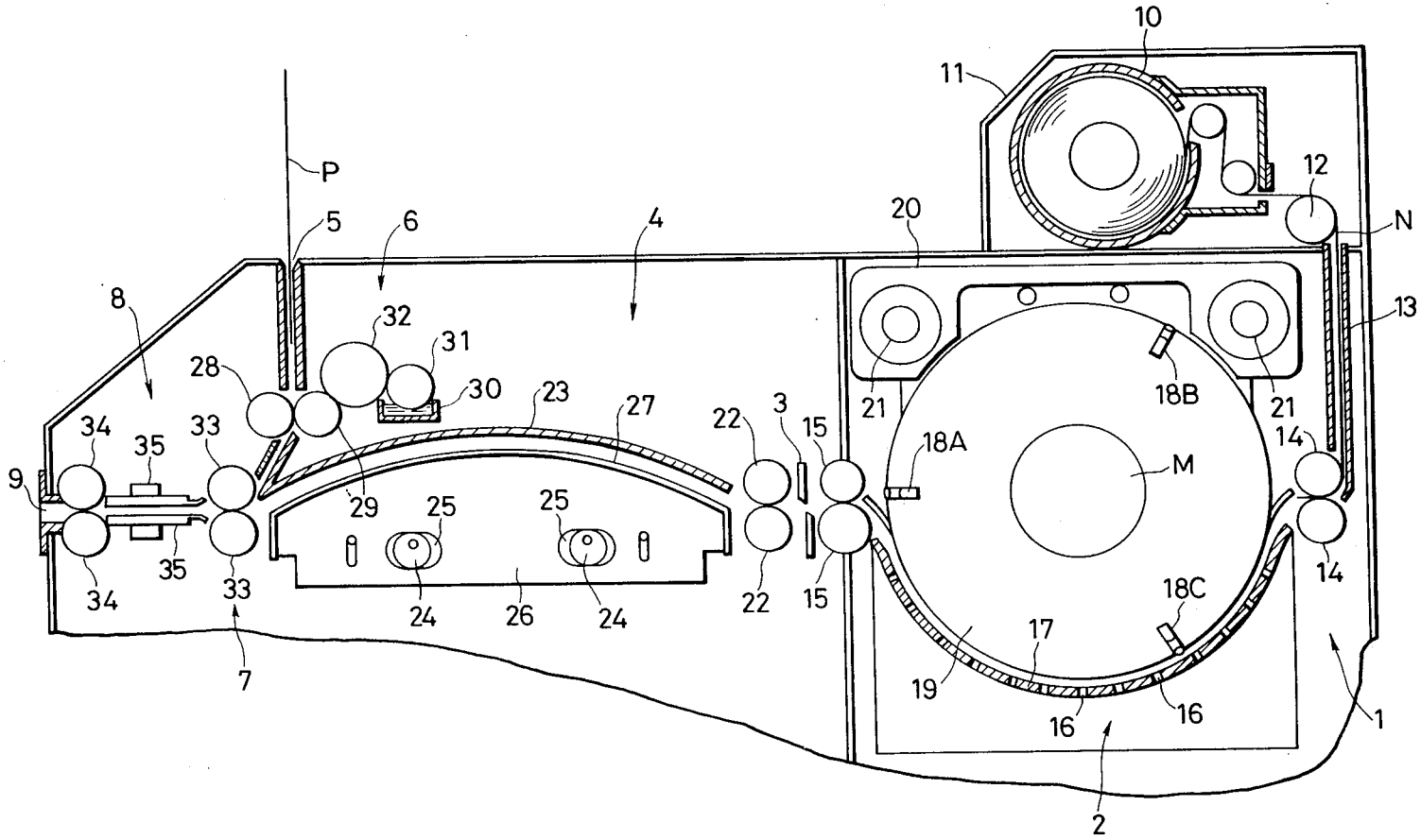
FIG. 1 is a side view showing the essential components of a first embodiment of an apparatus for practicing a thermal developing and transferring method according to this invention.

If, in the thermal developing and transferring method, the print paper is applied with a diffusion agent before being laid over the developed photosensitive paper, then the transferring operation is carried out more satisfactorily; however, use of the diffusion agent is not always required. In the case where a melting diffusion agent is employed, a material such as urea suspended in crystalline form in water can be employed as the diffusion agent. Alternately, microcapsules which become aqueous, or discharge water, when heated, or a melting material which becomes hydrophilic when heated can be used. In these cases, it is unnecessary to apply the diffusion agent to the print paper in the overlaying step. In the case where water or basic aqueous solution is employed as the diffusion agent, the agent is applied to the print paper in the overlaying step. In the case where the print paper is of the melting diffusion agent type, first the overlaying step is carried out to lay the print paper on the thermal developing photo-sensitive paper, and then the thermal developing step and the transferring step are carried out. In this case, heating causes the hydrophilic paper to melt or the water suspension or microcapsules to discharge the diffusion agent, thus facilitating the transferring operation. It is to be understood that by paper is meant any type of sheet-like or roll-like flexible material.

In the case where water is employed as the diffusion agent, the quantity of water should be at least 10% of the dry weight of the total coating on the film consisting of the photo-sensitive layer of the thermal developing photo-sensitive paper and the pigment fixing layer. The water quantity should be at most a value which is obtained by subtracting the dry weight from the weight of the totally coated film that is maximally swelled.

The heating temperature in the thermal developing step is about 80° C. to about 250° C., preferably about 110° C. to about 160° C. In the transferring step, transferring is acheived satisfactorily at temperatures ranging from room temperature to a heating temperature employed in the thermal developing step. Preferably the upper end of the temperature range should be 10° C. cooler than the temperature employed in the thermal developing step. For instance, when the thermal developing temperature is 120° C., then the transferring temperature is between 20° C. and 110° C.

In the thermal developing step, the following heating means may be employed. The photo-sensitive paper is brought into contact with a hot plate or a hot rotating drum or roller, or it is passed through heated air, or it is caused to run adjacent to a heat source by means of rollers or belts. Alaternatively, an electrical heat generating layer of graphite, carbon black or metal formed on the thermal developing paper is resistively heated, so that the thermal developing paper is directly heated.

The electrical heat generating layer may be formed by a conventional method. For instance, a powder of electrically conductive paper such as carbon, titanium or titanium oxide is pulverized into fine powder, and the fine powder thus prepared is mixed with gelatinous aqueous solution or PVA aqueous solution to produce a mixture. The mixture is applied to the support layer of the thermal developing photosensitive paper and is then dried.

The electrical heat generating layer may be formed before or after the photo-sensitive layer is deposited. An electrical heat generating film may be bonded to the support layer of the thermal developing photo-sensitive paper, or it may itself be used as the support. It is preferable to form the electrical heat generating layer on the rear side of the thermal developing photo-sensitive paper; however, it may be provided between the support layer and the photosensitive layer. Alternatively, a fine powder of electrically conductive paper may be mixed with an emulsion which forms the photo-sensitive layer, so that the photo-sensitive layer also serves as electrical heat generating layer. The electrical heat generating layer may contain not only the electrical heat generating material but also other materials which may improve the photographic and physical properties of the film.

The transferring step may use the same heating means as the thermal developing step.

A source for image exposing light for recording latent images on the thermal developing photo-sensitive paper may utilize several types of radiation including visible light. Generally stated, a light source for ordinary color prints may be employed. For instance, a tungsten lamp, a mercury lamp, a halogen lamp such as an iodine lamp, a xenon lamp, a laser source, a CRT light source, a fluorescent lamp, or a light emitting diode may be used as the light source.

Not only high contrast pictures such as line drawings, but also photographs with intensity gradations may be used as the original picture. Furthermore, people or landscapes may be photographed with cameras. The image of an original picture may be printed on the thermal developing photo-sensitive paper by a contact type printing method in which a thermal developing photo-sensitive paper is put on top of an original picture, or by a reflection type printing method, or by an enlargement type printing method. If video signals from a television broadcast station are applied to a CRT (cathode ray tube) or an FOT (fiber optics cathode ray tube), the image may be printed on the thermal developing photo-sensitive paper with a contact printing system or by forming the image on the photo-sensitive paper with a lens.

If a light emitting diode is used as the exposing means, it is difficult to obtain blue light of sufficient intensity. In order to reproduce a color image in this case, the thermal developing photo-sensitive paper should be so designed that exposure is carried out with three different light emitting diodes which emit green, red and infrared light, respectively, and layers sensitive to these radiations which expel yellow, magenta and cyan dyes, respectively. In other words, in the thermal developing photo-sensitive paper, the green sensing part (or layer) contains a yellow pigment carrier, the red light sensing part (or layer) a magenta pigment carrier, and the infrared light sensing part (or layer) a cyan pigment carrier.

In addition to the method in which an original picture is brought into close contact with the photo-sensitive paper or its image is projected onto the photo-sensitive paper, a method may be employed in which an original picture is illuminated by a light source and the reflected light is read by a light receiving element such as a photoelectric tube or a charge-coupled device (CCD) so that its data are stored in a computer memory. After being subjected to image enhancement, or processed as required, the data are reproduced on a CRT so as to be utilized as an image-like light source. Alternately, exposure is carried out in a scanning manner by causing three different light emitting diodes to emit light according to the values of the data.

In the removing step, the print paper to which the image has been transferred is separated or peeled off from the photo-sensitive paper. If, in this case, the photo-sensitive paper and the print paper are used in the form of rolls, it is unnecessary to use a scraper because the print paper can be peeled off from the photo-sensitive paper as these rolls are rewound. In other cases, it is necessary to use conventional scrapers.

The apparatus for thermal developing and transferring according to the method of the invention will be described.

FIG. 1 is a side view of a first example of the thermal developing and transferring apparatus in which a thermal developing photo-sensitive paper in the form of a roll is carried to an image exposing section where it is subjected to exposure by scanning by three different light emitting diodes (which are used instead of laser beams as disclosed by Japanese Patent Laid-Open No. 15193/1981). The photo-sensitive paper thus processed is developed by being heated by a hot plate. Also, sheet-like print paper, after being coated with a diffusion agent (water in this case) is put on top of the thermal developing photo-sensitive paper. The combined sheets are then heated while being moved beside a heat source so that the image is transferred onto the print paper. Finally, the print paper is manually peeled off from the thermal developing photo-sensitive paper.

The apparatus comprises a photo-sensitive paper supply section 1, and image exposing section 2, a cutter 3, a thermal developing section 4, a print paper insertion inlet 5, a diffusion agent application section 6, an overlaying section 7, a thermal transferring section 8 and a discharge outlet 9.

The photo-sensitive paper supply section 1 comprises: a magazine loading chamber 11 in which a magazine containing a thermal developing photo-sensitive paper N in the form of a roll is loaded in such a manner that it is shielded from light, a guide roller 12, a guide member 13, and feed rollers 14 and 14, and 15 and 15 which are adapted to carry the photo-sensitive paper N to the image exposing section 2.

The image exposing section 2 comprises: a photosensitive paper supporting plate 17 having suction holes 16 for pulling the photo-sensitive paper N from behind; a rotary member 19 for performing the main scanning; a moving member 20 provided with a motor coupled to the rotary member 19 for rotating it and threaded rotary shafts 21 and 21 for moving and suspending the moving member 20 in the auxiliary scanning direction. The rotary member 19 has light emitting diodes 18A, 18B and 18C arranged at angular intervals of 120°. These diodes provide outputs of different optical wavelength light with the optical intensities and light emitting times adjusted according to the blue, green and red image signals.

The thermal developing section 4 comprises: feed rollers 22 and 22; a curved guide plane 23; and a hot plate 27 located on a stand 26 having elongated holes 25 which are engaged with cams 24. The plate 27 is moved toward the guide plate 23 as the cams 24 turn.

The diffusion agent application section 6 comprises a coating roller 29 and a feed roller 29 which are adapted to coat a print paper P in the shape of a sheet with a diffusion agent. The sheet is manually inserted through the print paper insertion inlet 5 and is carried to the overlaying section 7. The diffusion agent application section further comprises: a liquid tank 30 containing the diffusion agent (water in this case); a roller 31 for drawing water from the tank 30; and a water roller 32 for delivering water which is drawn from the tank in the form of a uniform liquid to the coating roller 29.

The overlaying section 7 comprises a pair of contact rollers 33 and 33 for laying photo-sensitive paper N that has been subjected to thermal development onto a print paper P coated with the diffusion agent. The rollers 33 and 33 send the two sheets of papers N and P thus combined to the thermal transferring section 8.

The thermal transferring section 8 comprises a pair of feed rollers 34 and 34 adapted to discharge the photo-sensitive paper N and the print paper P through the discharge outlet 9 at a speed equal to the speed of the contact rollers 33 and 33. The sheets of paper N and P are also joined together by the contact rollers 33 and 33. The thermal transferring section also comprises heaters 35 and 35 for heating the papers N and P from above and below.

Under the condition that the rollers 14 and 14 hold the thermal developing photo-sensitive paper N which has been pulled out of the magazine 10 and sent through the guide roller 12 and the guide member 13, when the feed rollers 14 and 15 are turned, the paper N is moved along the photo-sensitive paper supporting plate 17 until its front end is held by the feed rollers 15 and 15. Thereafter, the paper N is brought into close contact with the photo-sensitive paper supporting plate 17 by the air pumped through the suction holes 16. Under this condition, the rotary member 19 and the rotary shafts 21 are rotated while blue, green and red image signals are being applied to the light emitting diodes 18A, 18B and 18C so that the exposure is carried out in a scanning mode. After the exposure, the feed rollers 14, 15 and 22 and the contact rollers 33 are rotated. As a result, the photo-sensitive paper N is run through the edges of the cutter 3 and thence through the feed rollers 22 and to the space between the guide plate 23 and the hot plate 27 until its front end is held by the contact roller 33. Thereafter, the cutter 3 is operated to cut the photo-sensitive paper N at a position between the feed rollers 15 and 22. Then, the cams 24 rotate so as to lift the hot plate 27, so that it is brought uniformly in close contact with the rear surface of the thermal developing photo-sensitive paper N to subject it to development by heat. After a predetermined developing time has passed, the cams 24 are turned to lower the hot plate 27. The developing operation is thus accomplished.

A print paper P is inserted through the print paper insertion inlet 5. The paper P is moved while being coated with the diffusion agent by the feed roller 28 and the coating roller 29. When the forward end of the print paper P reaches the contact rollers 33, the surface of the print paper P coated with the diffusion agent is laid on top of the surface of the developed photo-sensitive paper N. These papers thus laid one on another are heated while being passed between the heaters 35 and 33. The transferring operation is thus carried out. The papers so treated are discharged through the discharg outlet 9. When the print paper P is removed from the developed photo-sensitive paper N, a hard copy appears on the paper P.

Figure 2:
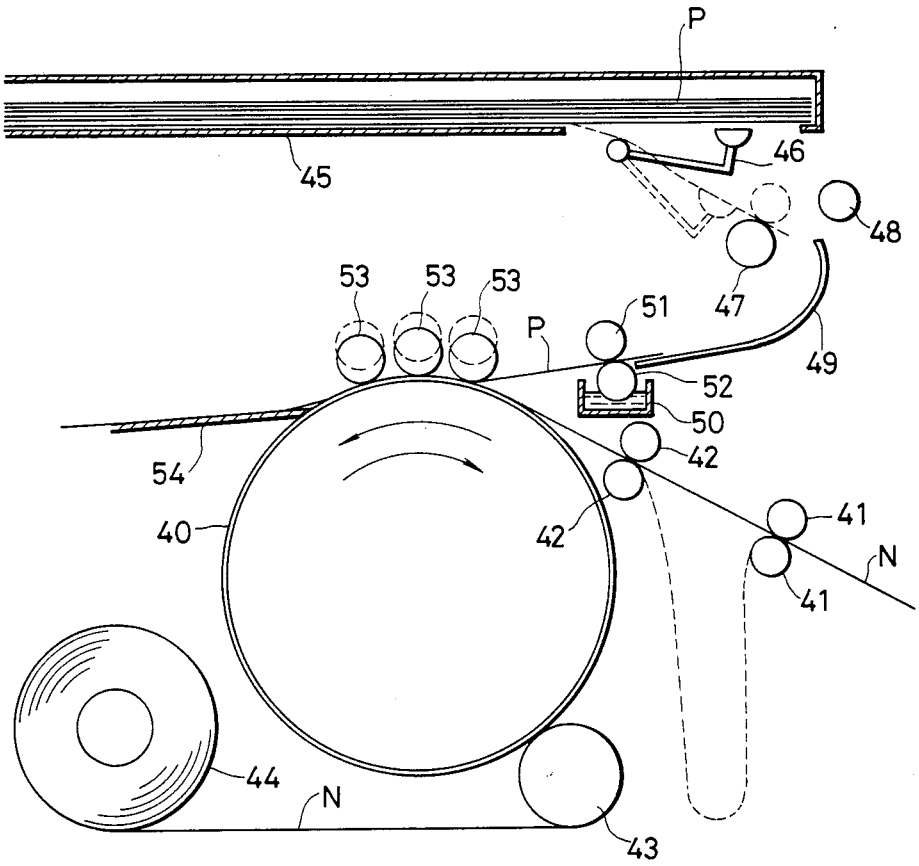
FIGS. 2, 3, 4 and 5 are side views showing the essential components of second, third, fourth and fifth embodiments of the apparatus according to the invention.

FIG. 2 is a side view of a second thermal developing and transferring apparatus in which a thermal developing photo-sensitive paper is laid on a hot drum so that its developing operation is carried out by heating it. The same hot drum is also used for the transferring operation.

The apparatus comprises: a developing and transferring hot drum 40 which can be turned in the forward and reverse directions; two pairs of feed rollers 41 and 42 for carrying the thermal developing photosensitive paper N in the form of a roll which has been exposed and forming a loop in the paper N; a guide roller 43 which follows the rotation of the hot drum 40; and a winding roll 44 which utilizes a friction drive to rewind the used photo-sensitive paper. The sheet delivery section of the apparatus comprises a magazine 45 containing a stack of sheets of print paper P; a suction and retaining link mechanism 46 for taking the print sheets P one by one; a delivery roller 47; a backup roller 48 which can be moved to near the delivery roller 47; a guide plate 49; a liquid tank 50 containing a diffusion agent (water in this case); and a coating roller 52 for drawing water from the liquid tank 50 which coats the surface of the print sheet P with the diffusion agent in cooperation with a back-up roller 51. The developing and transferring section comprises: the hot drum 40; transferring rollers 53, 53 and 53 which are pressed against the hot drum 40 with the photo-sensitive paper N and a print sheet P in between, and a scraper 54 for removing the print sheet P onto which an image has been transferred from the photo-sensitive paper N.

The leader of a roll of exposed photo-sensitive paper N is passed through the feed rollers 41 and 42, wound around the hot drum 40 so that it is passed between the drum 40 and the guide roller 43, and rewound onto the winding roll 44. In this operation, the transferring rollers 53 are separated from the hot drum 40 as indicated by the dotted lines. Under this condition, the hot drum 40 is turned counterclockwise and the exposed part of the roll N is passed through the feed rollers 41 and 42 and is brought into close contact with the cylindrical surface of the hot drum 40, so that it is developed by being heated. After the developing operation, the hot drum 40 is turned clockwise while the feed rollers 42 are turned in the opposite direction. As a result, the developed part of the paper N is formed into a predetermined loop as indicated by the dotted line.

Then, the transferring rollers 53, 53 and 53 are brought into contact with the hot drum 40, and the suction and retaining link mechanism 46 is operated. When the top end of a print paper P reaches the delivery roller 47, the back-up roller 48 is brought into contact with the roller 47 as indicated by the dotted line. When, under this condition, the delivery roller 47 and the coating roller 52 are turned, the diffusion agent is applied to the surface of the print sheet P taken out of the magazine. When the front edge of the sheet P reaches the first transferring roller 53, the hot drum 40 is put on the thermally developed part of the photo-sensitive paper N, and the image is transferred onto the print sheet P.

The print sheet P thus treated is peeled off from the photo-sensitive paper N by the scraper 54 beginning with the front edge. This sheet provides a hard copy. The used photo-sensitive paper N is wound on the winding roll 44. As is apparent from the above description, the thermal developing step and the transferring step are carried out with only one hot drum 40, and accordingly these steps are performed substantially at the same temperature. However, if the heater in the hot drum is turned off when the thermal developing operation has been achieved, then the transferring operation can be carried out with the remaining heat whose temperature is lower than the thermal developing temperature.

Figure 3:
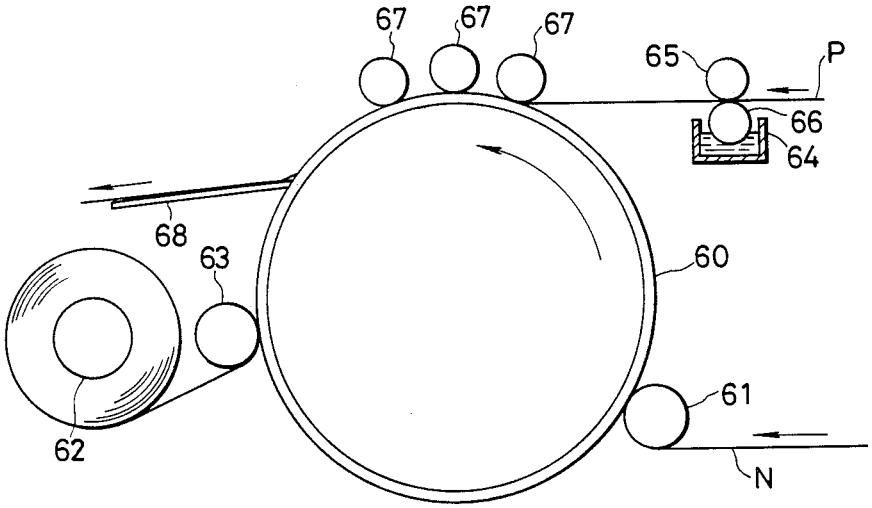

FIG. 3 is a side view of a third thermal developing and transferring apparatus in which a thermal developing photo-sensitive paper is laid on a hot drum so that it is thermally developed, and a print paper is supplied to the hot drum so as to be laid on on the photo-sensitive paper which is developed on the hot drum, so that a first half of the hot drum is used for thermal developing and the remaining half for transferring.

The apparatus comprises: a hot drum 60 which turns in one direction; a guide roller 61 which, following the rotation of the hot drum 60, supplies a thermal developing photo-sensitive paper N to the hot drum 60 and brings it into close contact with the surface of the hot drum 60; a winding roll 62 operated with a frictional drive to rewind the used photosensitive paper N; a guide roller 63 for removing the used photo-sensitive paper P from the hot drum 60 and guiding it to the winding roll 62; a liquid tank 64 containing a diffusion agent (water in this case); a coating roller 66 for drawing water from the tank 64 to apply it to a print paper P in cooperation with a back-up roller 65; transferring rollers 67, 67 and 67 for pressing the layers of the developed photo-sensitive paper N and the print paper P against the hot drum 60; and a scraper 68 for peeling off print paper P onto which the image has been transferred from the photo-sensitive paper N.

The leader of a roll of the thermal developing photo-sensitive paper N is wound around the guide roller 61 and around the hot drum 60. The leader is further placed around the guide roller 63 and is then rewound on the winding roll 62. As the hot drum 60 is turned counter-clockwise, the exposed part of the photo-sensitive paper N is brought into close contact with the cylindrical surface of the hot drum 60 by the guide roller 61, so that it is developed by heat. On the other hand, as the coating roller 66 is turned, the diffusion agent is deposited on the surface of the print paper P. The transferring rollers 67 put the print paper P on top of the photo-sensitive paper N developed on the hot drum 60, so that the image is transferred onto the paper P. The scrapper 68 peels off the print paper P thus treated from the photosensitive paper N beginning from the front edge thereof, thus providing a hard copy. The used photosensitive paper P is rewound onto the winding roll 62.

Figure 4:
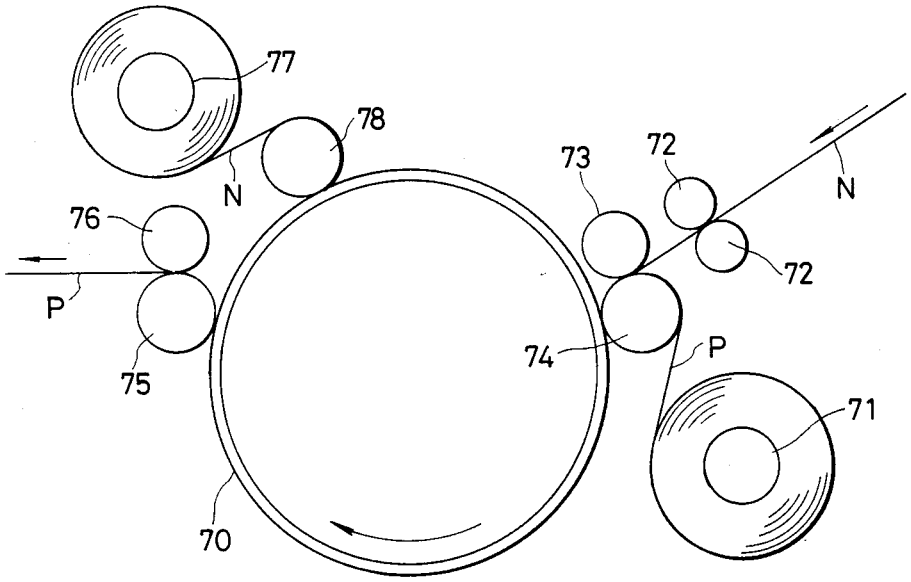

FIG. 4 is a side view of a fourth thermal developing and transferring apparatus operated according to a method in which a melting diffusion agent is applied in advance to a print paper or a thermal developing photo-sensitive paper. After a print paper and an exposed photo-sensitive paper are arranged in layers, the layers are led around a hot drum so that a developing step and a transferring step are simultaneously carried out.

The apparatus comprises: a hot drum 70 which turns in one direction; a supply roll 71 on which a print paper P is wound; a pair of feed rollers 72 and 72 for feeding exposed thermal developing photo-sensitive paper N in roll form; a guide roller 74 cooperating with a back-up roller 73 to put the photo-sensitive paper N and a print paper P in layers and to abut the layered paper against the hot drum 70; a guide roller 75 and a back-up roller 76 for peeling off the print paper P, onto which the image has been transferred; from the photo-sensitive paper N; a winding roll 77 which is operated with a frictional drive to rewind the used photo-sensitive paper N; and a guide roller 78 for guiding the used photo-sensitive paper N from the hot drum 70 to the winding roll 77.

The leader of the exposed photo-sensitive paper N, which has been passed through the pair of feed rollers 72 and 72, is laid on the print paper P coming from the supply rool 71. Then, these papers are passed between the rollers 73 and 74 and are then wound around the hot drum 70 in such a manner that the paper P is passed between the rollers 75 and 76. The leader of the photo-sensitive paper N is passed between the drum 70 and the roller 78 and is then rewound on the winding roller 77. As the hot drum 70 is turned clockwise, the photo-sensitive paper N is heated, so that the exposed part thereof expels a pigment. At the same time, the print paper P is also heated, so that a hydrophilic melting paper such as urea, water of crystallization or a micro-capsule is melted to allow a diffusion agent to ooze out. As a result, a pigment image is transferred onto the print paper P. The print paper P onto which the image has been transferred is removed from the photo-sensitive paper N and is discharged as a hard copy passing between the guide roller 75 and the back-up roller 76. The photo-sensitive paper N which has been used is wound on the winding roll 77.

The hot plate 27 in FIG. 1 and the hot drums 40, 60 and 70 in FIGS. 2, 3 and 4 have a silicone rubber heater as a heat source. In this type of heater, the heater wattage density is made high enough to maintain the peripheral temperature substantially uniform.

Figure 5:
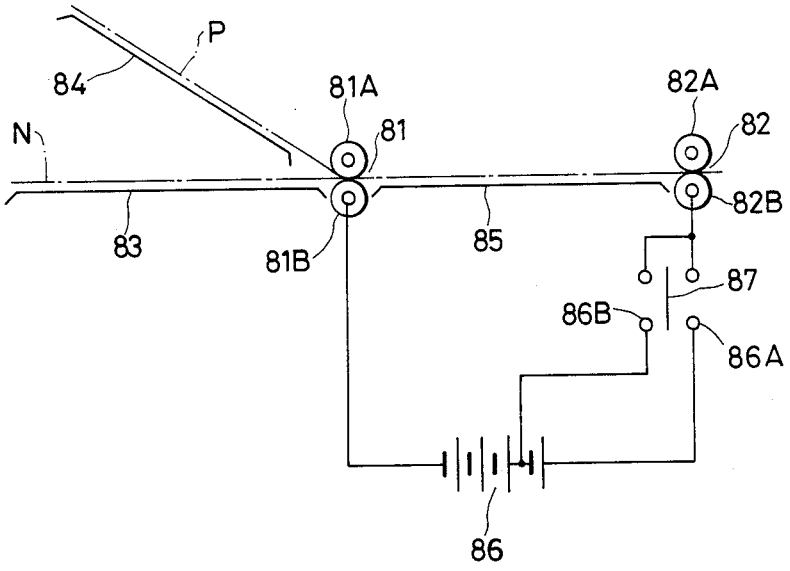

FIG. 5 is a side view of a fifth thermal developing and transferring apparatus operated according to a method in which a thermal developing photo-sensitive paper has an electrical heat generating layer. In this apparatus, a print paper and an exposed thermal developing photo-sensitive paper are electrically heated after being combined so that an image developing step and an image transferring step are simultaneously carried out.

The thermal developing photo-sensitive paper used in the apparatus has a photo-sensitive layer on one side and an electrical heat generating layer on the other side.

The apparatus comprises: a pair of rollers 81, a pair of rollers 82, guide plates 83, 84 and 85, and a power source 86. The roller pair 81 serves simultaneously as feeding means, layering means and electrode means, and is made up of a heat resistant rubber roller 81A and a metal roller 81B. The roller pair 82 serves both as feeding means and electrode means, and is made up of a heat resistant rubber roller 82A and a metal roller 82B. The power source 86 can supply different voltages, and is connected to the electrodes of the rollers 81B and 82B through a relay switch 87 having three positions.

The operation of the apparatus thus constructed is as follows. A thermal developing photo-sensitive paper N, on which an image or the like is formed is placed on the guide plate 83 with its photo-sensitive layer facing upward. On the other hand, a print paper P is placed on the guide plate 84 with its pigment fixing layer facing downward. When these paired papers N and P are inserted between the roller pair 81, the rollers 81 and 82 are driven by a control system (not shown), so that the papers N and P are combined by the roller pair 81. Thus, the paper pair N and P are moved on until the front edges reach the pair of rollers 82. Under this condition, the armature of the relay switch 87 is switched to the side of a terminal 86A providing a developing voltage from the power source 86. The developing voltage is applied between the electrodes of rollers 81B and 82B for a predetermined period of time. As a result, the electrical heat generating layer on the rear side of the thermal developing photo-sensitive paper N generates heat, whereby the photo-sensitive layer on the front side is heated to expel mobile hydrophilic pigment thus allowing the image to appear. At the same time, the print paper P is also heated. When it includes a molten diffusion agent, the diffusion agent begins to melt. During the second half of the developing period, the expelled pigment begins transferring to the pigment fixing layer. After a predetermined period of time, the armature of the relay switch 87 is tripped over to the side of a terminal 86B to provide a transferring voltage from the power source 86. The transferring voltage is lower than the developing voltage and is applied between the rollers 81B and 82B for another predetermined period of time. Thus the electrical heat generating layer is maintained at a temperature lower than the developing temperature. In this operation, and the mobile hydrophilic pigment expelled by the development is transferred to the pigment fixing layer of the print paper, so that a transferred pigment image is formed. In a predetermined period of time, the armature of the relay switch 87 is returned to its neutral position and the pairs of rollers 81 and 82 are driven again, so that the photo-sensitive paper N and the print paper P are discharged together. When the print paper P is peeled off from the photo-sensitive paper N, a color picture can be found on the print paper P.

In a concrete example of the apparatus as shown in FIG. 5, the thermal developing photo-sensitive paper was such that the length between the electrodes was 85 mm, the width along the electrodes was 60 mm, and the resistance of the electrical heat generating layer in the lengthwise direction was 600Ω. For development, about 125 V was applied between the electrodes to heat the papers to 140° C. During transferring, about 110 V was applied to heat them to 110° C. Accordingly, a current of 0.21 A flowed during development, and a current of 0.18 A during transferring.

The invention provides a novel thermal developing and transferring method. The invention should be highly appreciated in that the simple method provides color hard copies.

We claim:

1. An image recording apparatus comprising:

exposure means for scan exposing a front side of a thermally developable photo-sensitive material having an electrically heating layer in its back surface, said exposure means including means for modulating and activating light sources, having different wavelengths, in response to three basic color signals, thereby forming a latent image on said thermally developable photo-sensitive material;

a thermal development section having at least two electrode rollers brought into contact with said electrically heating layer provided on the back surface of said photo-sensitive material in which said latent image has been formed, said thermal development section applying a voltage between said electrode rollers and heating said electrically heating layer, thereby achieving the development of said thermally developable photo-sensitive material;

means for applying a diffusion agent in a fluid state to an image receiving material having a layer for pigments;

overlaying means for overlaying said image receiving material subjected to said diffusion with the developed photo-sensitive material;

transferring means for heating the overlaid image receiving material and photo-sensitive material at a temperature less than a temperature in said thermal development section, thereby transferring the image, formed in said photo-sensitive material, to said image receiving material; and peeling means for peeling the overlaid image forming material apart from said photo-sensitive material.

2. An image recording apparatus comprising:

(a) a magazine containing a wound roll of a thermally developable photo-sensitive material;

(b) delivering means for drawing said photo-sensitive material from said magazine and for delivering the photo-sensitive material to a subseqeunt exposure section;

(c) an exposure section having means for supporting the delivered thermally developable photo-sensitive material and means for exposing the photo-sensitive material;

(d) a thermal development section having thermal development means for performing thermal development in contact with the exposed thermally developable photo-sensitive material;

(e) a diffusion agent application section for applying a diffusion agent to an image receiving material, said diffusion agent application section including roller means and liquid tank means for containing the diffusion agent;

(f) an overlaying section for overlaying said image receiving material subjected to said diffusion agent with the developed thermally developable photo-sensitive material; and (g) a transferring section for heating the overlaid image receiving material and thermally developable photo-sensitive material to thereby transfer to said image receiving material to a pigment derived from the photo-sensitive material.

3. The apparatus according to claim 2, wherein said thermal development means includes a heating plate to be heated by a heater, said heating plate being brought into contact with and out of contact with the thermally developable photo-sensitive material to thereby carry out a desired thermal development.

4. The apparatus according to claim 2, wherein said transferring section heats the overlaid image receiving material and thermaly developable photo-sensitive material out of contact therewith to thereby carry out a desired thermal transfer process.

5. The apparatus according to claim 3, wherein said transferring section heats the overlaid image receiving material and thermally developable photo-sensitive material out of contact therewith to thereby carry out a desired thermal transfer process.

6. An apparatus for developing and transferring an image comprising:

(a) a heating drum for heating an exposed thermally developable photo-sensitive material wound around said heating drum to thereby carry out development and transfer processes;

(b) means for applying a diffusion agent in a fluid state to an image receiving material having a layer for pigments;

(c) delivery means for supplying said image receiving material to the thermally developable photo-sensitive material wound around said heating drum;

(d) transferring roller means for pressing the image receiving material supplied onto the thermally developable photo-sensitive material wound around said heating drum against said heating drum; and (e) peeling means for peeling the overlaid, thermally transferred image receiving material apart from the thermally developable photo-sensitive material, said peeling means being located adjacent to said heating drum.

7. An apparatus for developing and transferring an image comprising:

(a) means for applying a diffusion agent to one of an image receiving material and a thermally developable photo-sensitive material;

(b) an overlaying section having overlaying means for overlaying said thermally developable photo-sensitive material with said image receiving material;

(c) a thermally developing/transferring section having a heating drum for heating the thermally developable photo-sensitive material and image receiving material overlaid one on another and wound around said heating drum, thereby carrying out development and transfer processes simultaneously; and (d) a peeling section having peeling means for peeling and discharging the overlaid, thermally developed and transfer-processed image forming material apart from the thermally developable photo-sensitive material.

* * * * *